US007015660B2

(12) United States Patent
Fregoso

(10) Patent No.: US 7,015,660 B2
(45) Date of Patent: Mar. 21, 2006

(54) CIRCUIT FOR DRIVING COLD CATHODE TUBES

(75) Inventor: Gilbert Fregoso, Hamilton, MT (US)

(73) Assignee: Design Rite LLC, Walnut, CA (US)

( * ) Notice: Subject to any disclaimer, the term of this patent is extended or adjusted under 35 U.S.C. 154(b) by 15 days.

(21) Appl. No.: 10/672,371

(22) Filed: Sep. 25, 2003

(65) Prior Publication Data

US 2004/0056610 A1 Mar. 25, 2004

Related U.S. Application Data

(60) Provisional application No. 60/414,096, filed on Sep. 25, 2002.

(51) Int. Cl.
*H05B 37/02* (2006.01)

(52) U.S. Cl. ..... 315/360; 315/291; 315/209 R; 315/244; 315/307; 315/DIG. 5

(58) Field of Classification Search ..... 315/209 R, 315/291, 244, 307, 360, 362, 227 R, DIG. 5, 315/DIG. 7, 324
See application file for complete search history.

(56) References Cited

U.S. PATENT DOCUMENTS 5,384,516 A * 1/1995 Kawabata et al. ..... 315/160
5,495,405 A 2/1996 Fujimura et al.
5,615,093 A 3/1997 Nalbant
5,742,497 A 4/1998 Hashimoto et al.
5,828,187 A * 10/1998 Fischer ..... 315/291
5,854,543 A 12/1998 Satoh et al.
5,930,121 A 7/1999 Henry
5,959,412 A 9/1999 Ushijima
6,008,590 A * 12/1999 Giannopoulos et al. . 315/209 R
6,008,593 A 12/1999 Ribarich
6,118,221 A 9/2000 Kumasaka et al.
6,211,623 B1 * 4/2001 Wilhelm et al. ..... 315/224
6,525,492 B1 * 2/2003 Ribarich ..... 315/291

FOREIGN PATENT DOCUMENTS

DE 198 53 657 A1 5/2000
WO WO 01/98853 A1 12/2001
WO WO 02/077740 A1 10/2002

* cited by examiner

*Primary Examiner*—Haissa Philogene
(74) *Attorney, Agent, or Firm*—Saliwanchik,Lloyd & Saliwanchik

(57) ABSTRACT

The subject invention is a circuit for driving a cold cathode tube using a 110V power supply. Power is provided to the cold cathode tube through a direct current converter circuit. A resonance capacitor works in conjunction with the inductive storage device until the start resonance of the tube is attained as directed by a resistor/capacitor (R/C) network. Once the tube starts conducting, another R/C network maintains and controls the circuit at a run resonance. The main driver is an oscillator with a high side and low side MOSFET driver.

12 Claims, 9 Drawing Sheets

CIRCUIT FOR DRIVING COLD CATHODE TUBES

CROSS REFERENCE TO RELATED APPLICATIONS

This application claims priority to U.S. Provisional Patent Application Ser. No. 60/414,096, filed Sep. 25, 2002. The disclosure of this application is hereby incorporated by reference in its entirety, including all figures, tables, and drawings.

BACKGROUND OF THE INVENTION

The gaming industry is a billion dollar-a-year business. Profits are high, but overhead expenses, including the energy required to heat and cool a casino 24 hours a day, and the energy required to supply power to the gaming machines, can be staggering. With current energy supplies strained, and the cost of power is skyrocketing, gaming profits are being depleted. The displays of most gaming machines are back-lit by flourescent lamps. Flourescent lamps use a considerable amount of energy and produce a lot of heat. Further, when these lamps are provided with too much current, light output weakens and becomes irregular. Many circuits have been designed in an attempt to drive flourescent lamps and cold cathode flourescent lamps more efficiently (U.S. Pat. No. 5,495,405, U.S. Pat. No. 5,854,543, U.S. Pat. No. 5,930,121, U.S. Pat. No. 5,959,412, U.S. Pat. No. 6,118,221). Replacing standard flourescent lamps used to back-light gambling machines with cold cathode tubes driven by an energy efficient, reliable circuit that produces little heat would prove to be a profitable savings for the gaming industry.

All patents, patent applications, provisional patent applications and publications referred to or cited herein, are incorporated by reference in their entirety to the extent they are not inconsistent with the explicit teachings of the specification.

SUMMARY OF THE INVENTION

The invention involves a circuit for driving cold cathode tubes. An oscillator drives MOSFETs which are driven at a precise frequency. The MOSFETs drive resonant elements including the cold cathode tube. The resonance circuit does not feedback to the oscillator therefore the circuit experiences no loading and can be placed up to about 18 feet from the cold cathode tube.

The circuit of the subject invention has an oscillator with a high side and low side MOSFET device. The oscillator drives high voltage MOSFETs which drive the resonance elements. The resonance elements include an inductive storage device, a resonance capacitor and the cold cathode tube. A start resonance and a run resonance are achieved and controlled by resistor/capacitor networks.

DETAILED DESCRIPTION OF THE INVENTION

The invention involves a circuit to drive a cold cathode lamp. An oscillation circuit drives MOSFETs at a precise frequency to drive resonance elements including a single wound inductive storage device, a resonance capacitor and a cold cathode tube. Resonance frequency is controlled by resistor/capacitor networks that direct the oscillator to achieve a start-up frequency to cause the tube to conduct and the run frequency to illuminate the device. The circuit does not experience loading since the resonance elements do not feedback to the oscillator thus the intensity of the lamp does not vary. The subject circuit is extremely efficient using 80% of the input power to provide light and losing only 20% of the input power as heat. Further, the circuit, unlike conventional circuits used to power cold cathode lamps, can be placed a distance from the source allowing greater flexibility in its positioning and placement.

A particular advantage of the circuit of the subject invention is that it allows a cold cathode tube to be driven off-line by a conventional 120 volt (V) source. Therefore, the exemplified embodiments of the subject invention include direct current (DC) converter circuits. It is noted however that the subject circuit can be powered directly by a DC power source.

Figure 1:
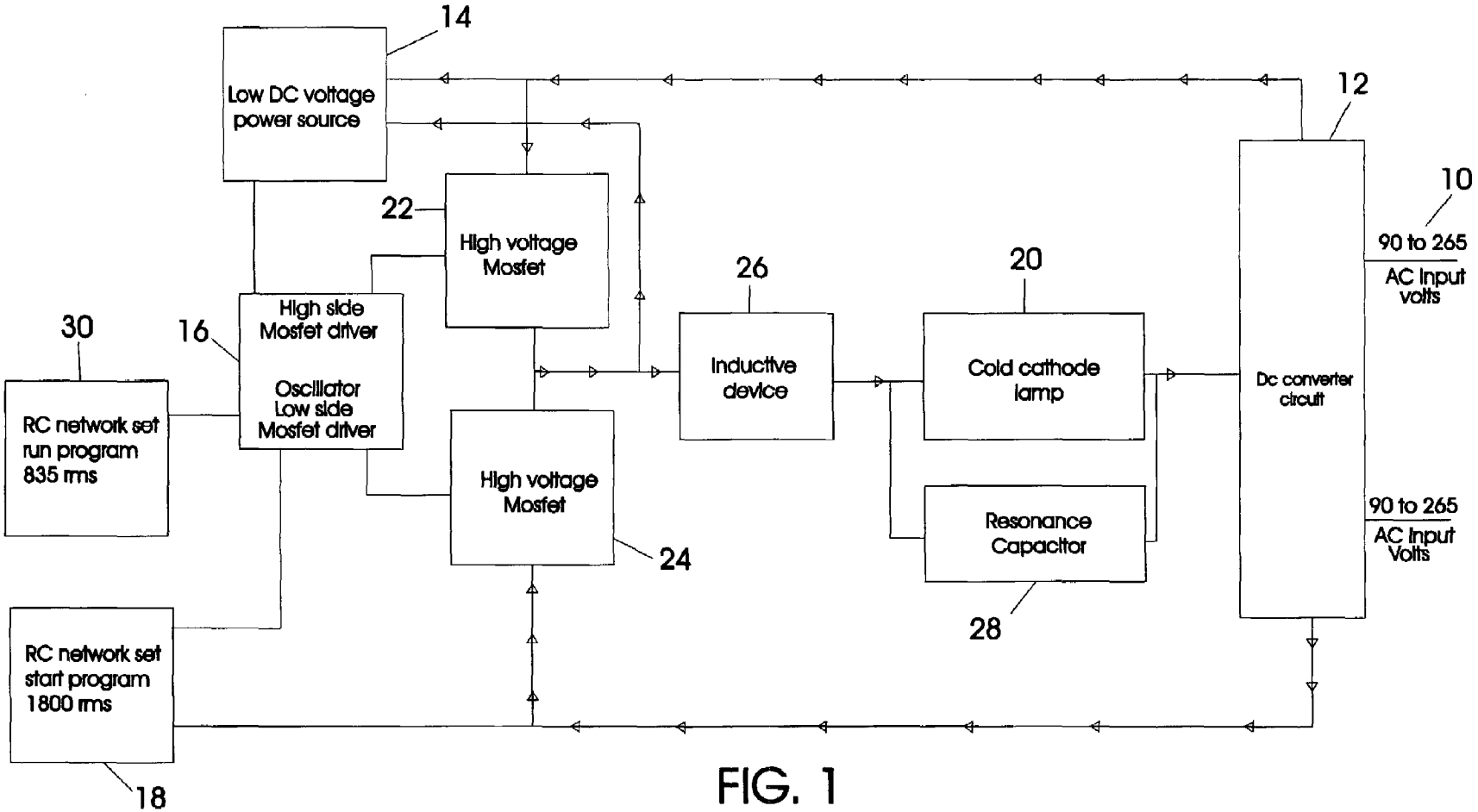
FIG. 1 is a schematic diagram showing a preferred embodiment of the circuit of the subject invention.
Figure 2:
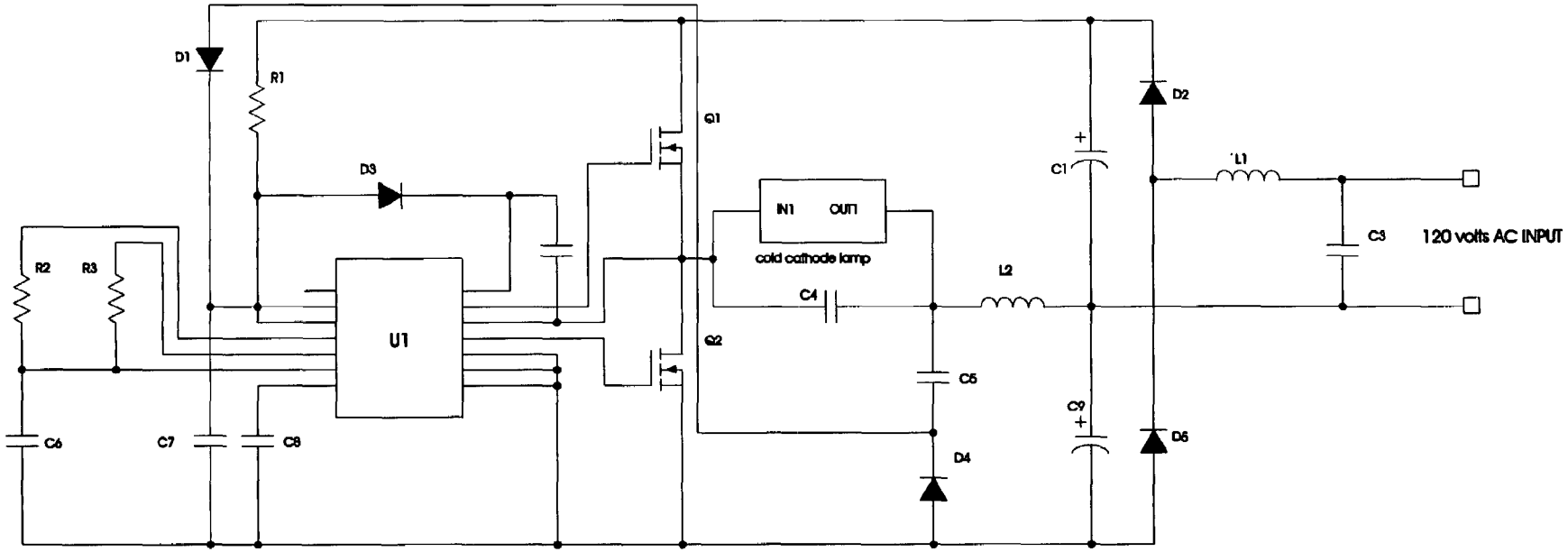
FIG. 2 is a circuit diagram of the preferred embodiment of the circuit shown in FIG. 1.

A schematic drawing of a preferred embodiment of the circuit of the subject invention is shown in FIG. 1. FIG. 2 provides a circuit diagram of that schematic drawing. In this embodiment, alternating current (AC) input 10 of from about 90 V to about 265 V and more particularly 120 V is directed to a DC converter circuit 12. In this embodiment the DC converter circuit is a split voltage circuit that rectifies and filters the AC input to DC. Positive current is sent to a low DC voltage power source 14 which supplies power to the integrated circuit (IC)/oscillator 16. The oscillator 16 has a high side MOSFET driver and a low side MOSFET driver. The oscillator 16 drives high voltage MOSFETs 22, 24 to drive the resonance elements which include a single wound inductive storage device 26, a resonance capacitor 28 and a cold cathode tube 20. A resistor/capacitor (R/C) network 18 ramps up the power to a resonance sufficient to cause the cold cathode lamp 20 to conduct. This first resonance, or start frequency, is for example, a resonance of 2500 V AC sufficient to charge a 4.2 mm×18 inches cold cathode tube. A run program executed by another R/C network 30 brings the system to a second resonance, its run resonance, to maintain a constant, reliable source. For the 4.2 mm×18 inches tube, the run resonance is about 800–850 V AC. The subject circuit is a sinusoidal inverter circuit that runs at a frequency of about 25 kilohertz (KHz) to about 100 KHz.

Figure 3:
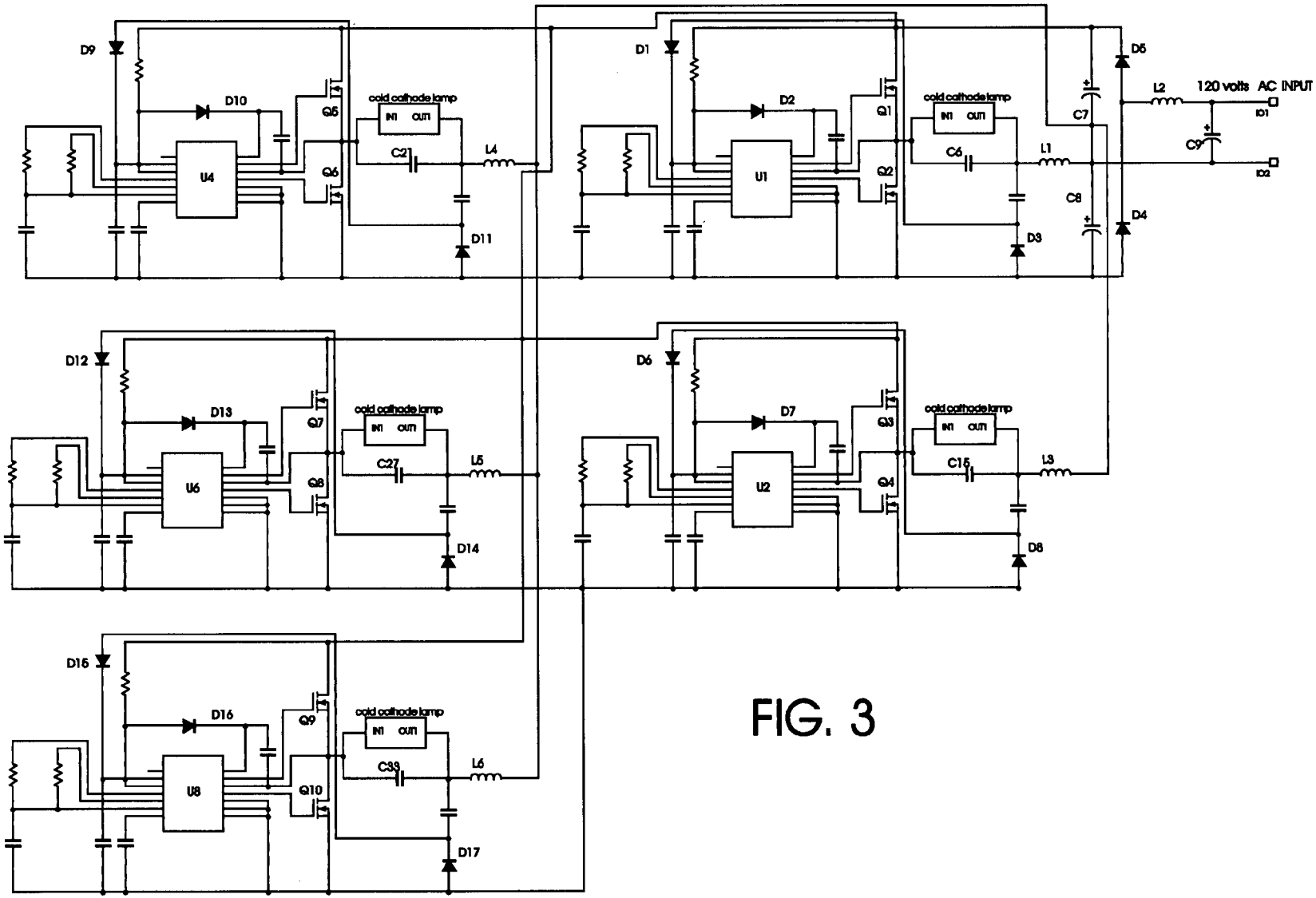
FIG. 3 is a circuit diagram of a plurality of the preferred embodiment of the circuit shown in FIG. 1 each driving a cold cathode tube while all are powered by a single input.

FIG. 3 is a circuit diagram of the preferred embodiment shown in FIG. 2 where a plurality of cold cathode lamps are powered by a single AC input. Each lamp is supported by the entire circuit shown in FIG. 2. Five lamps are being illuminated in FIG. 3, the efficiency of the circuit of the subject invention however allows any number of cold cathode lamps to be powered by a single AC input.

Figure 4:
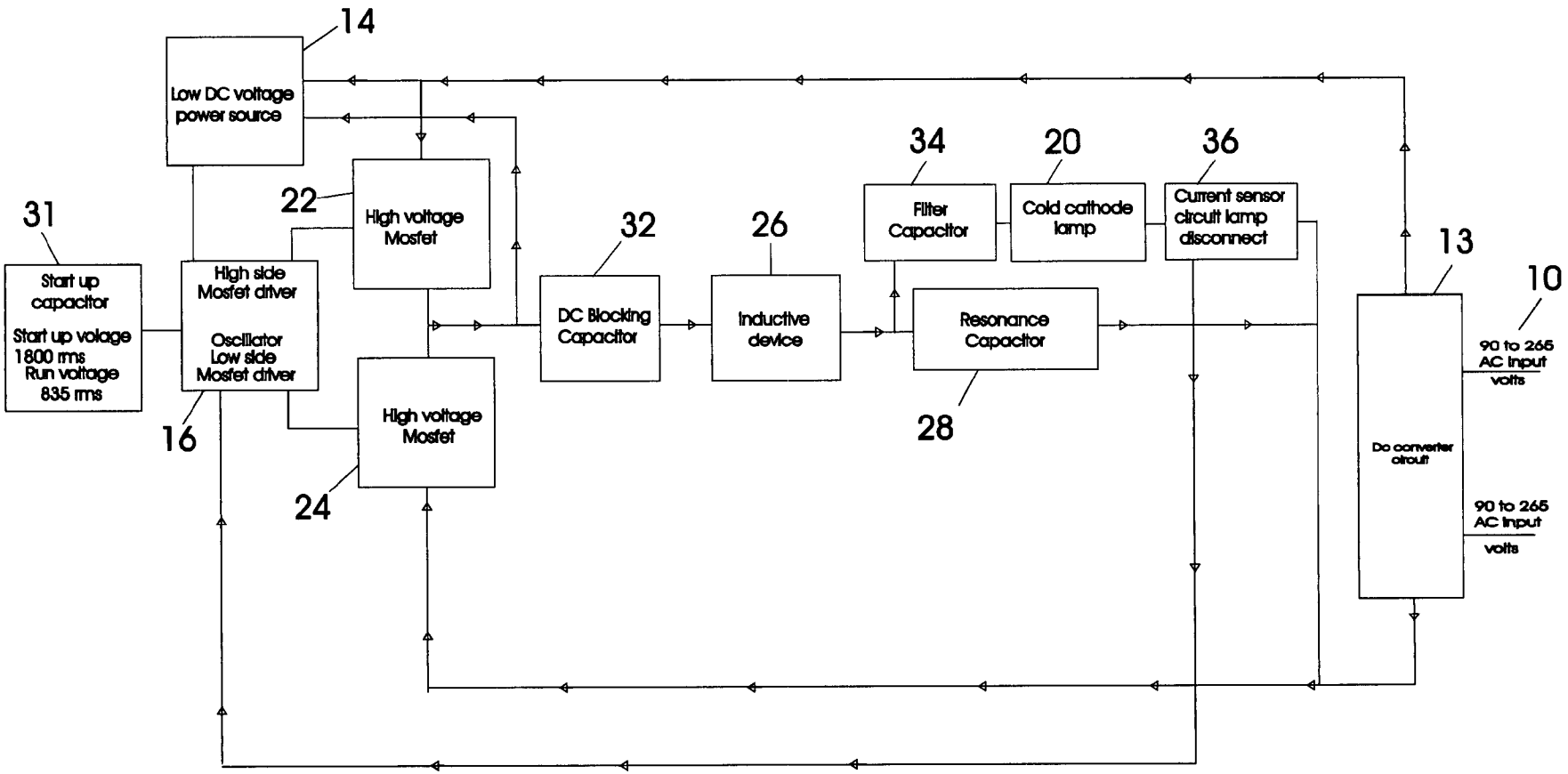
FIG. 4 is a schematic diagram of another preferred embodiment of the circuit of the subject invention.
Figure 5:
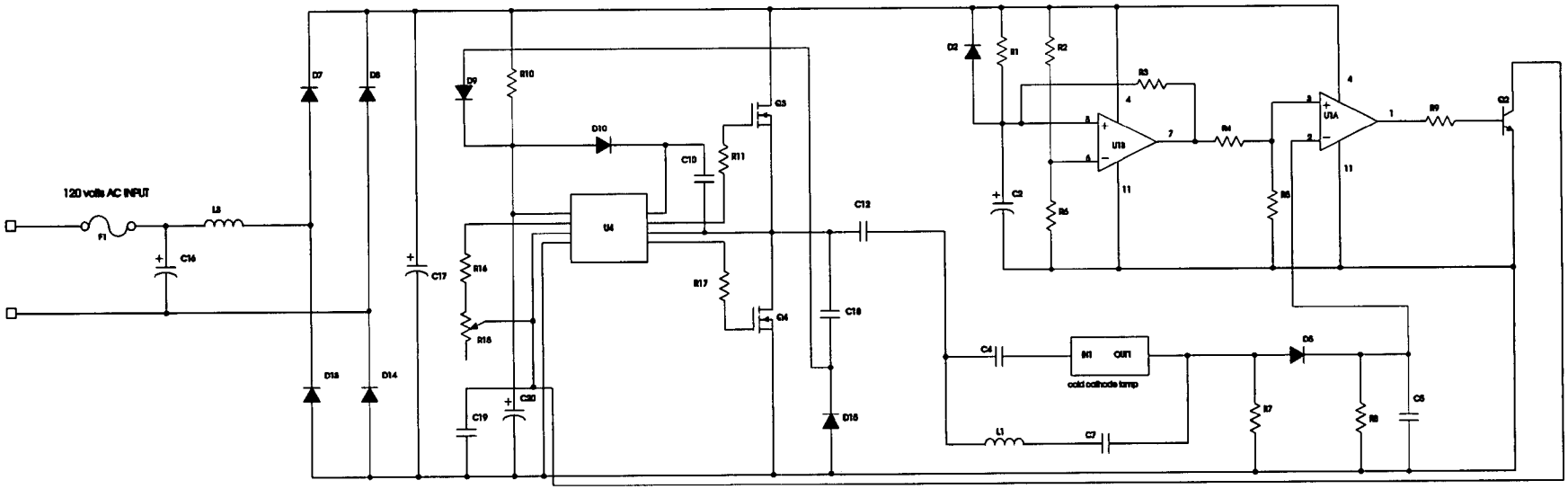
FIG. 5 is a circuit diagram of the preferred embodiment of the circuit shown in FIG. 4.
Figure 6:
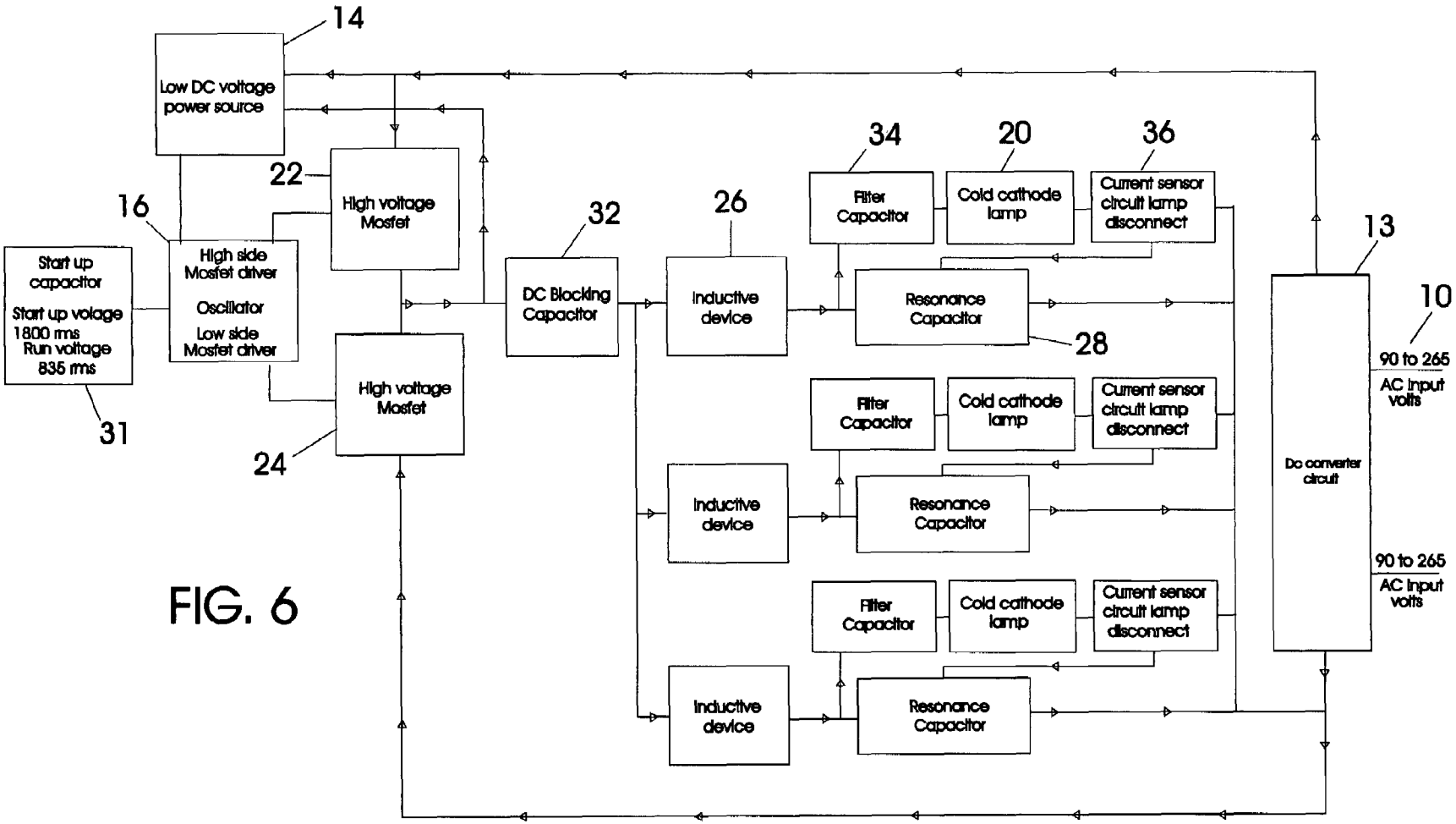
FIG. 6 is a schematic diagram of the preferred embodiment of the circuit shown in FIG. 4 driving three cold cathode tubes.
Figure 7:
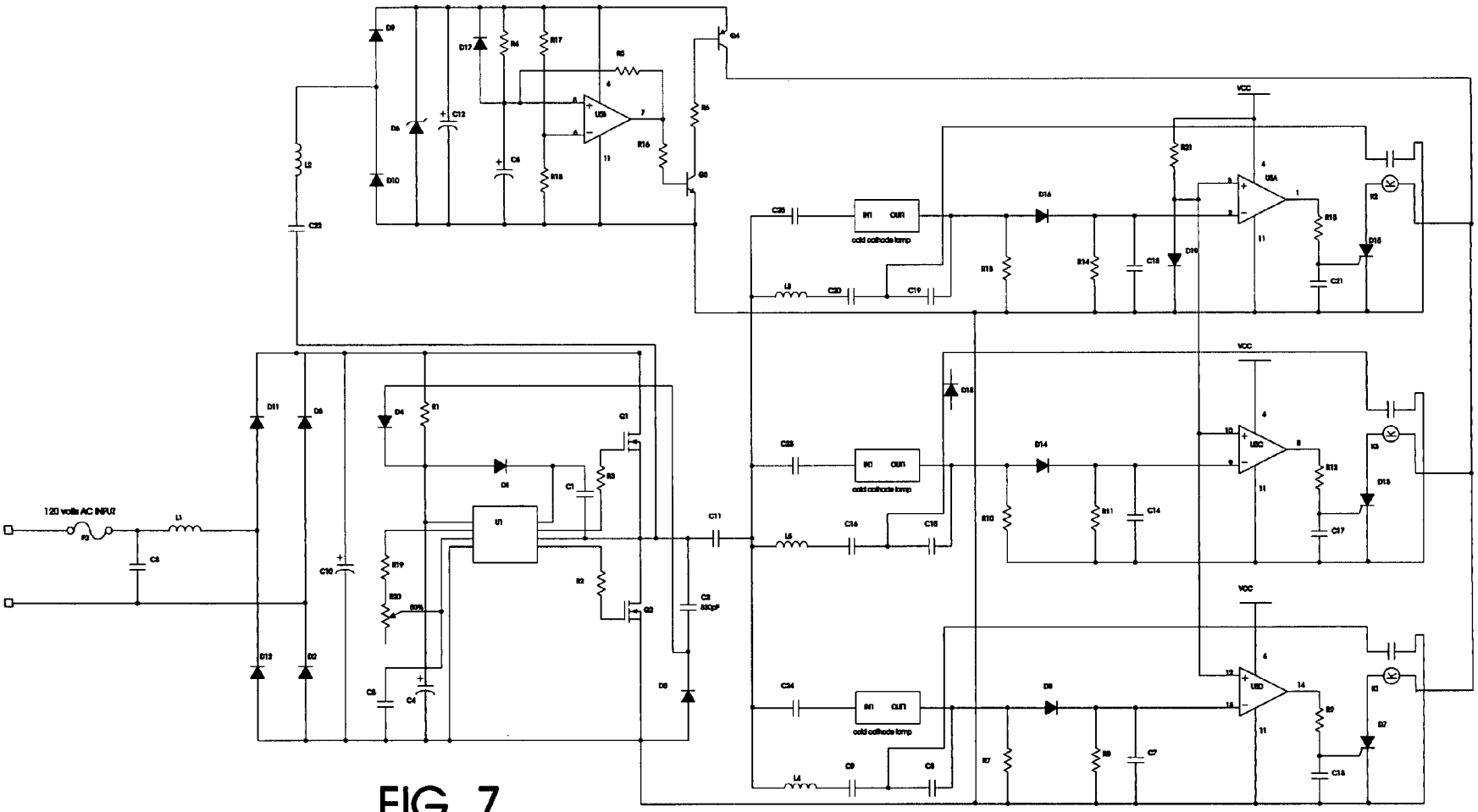
FIG. 7 is a circuit diagram of the preferred embodiment of the circuit shown in FIG. 6.

Another preferred embodiment of the circuit of the subject invention is shown in FIGS. 4 and 5. FIG. 5 provides the circuit diagram of the schematic shown in FIG. 4. In this embodiment, AC input 10 enters a DC converter circuit 13 that is a full wave circuit. A DC blocking capacitor 32 is therefore included in the subject embodiment. The circuit comprises a single R/C network 31 to control resonance frequency. In this embodiment, a filter capacitor 34 has been added to the resonance elements. A current sensor 36 detects a lamp outage and will shut down the oscillator 16. This preferred embodiment is particularly advantageous when used to illuminated more than one cold cathode tube. FIGS. 6 and 7 show that only the resonance elements and current sensor need to be repeated when adding further tubes to the circuit. The multiple lamp system is controlled by a single RC network 31 and is driven by a single oscillator 16 which decreases the cost of the circuit. If the current sensor 36 detects a lamp outage in the multiple lamp system, the resonance elements supplying that lamp are disconnected from the circuit.

Figure 8:
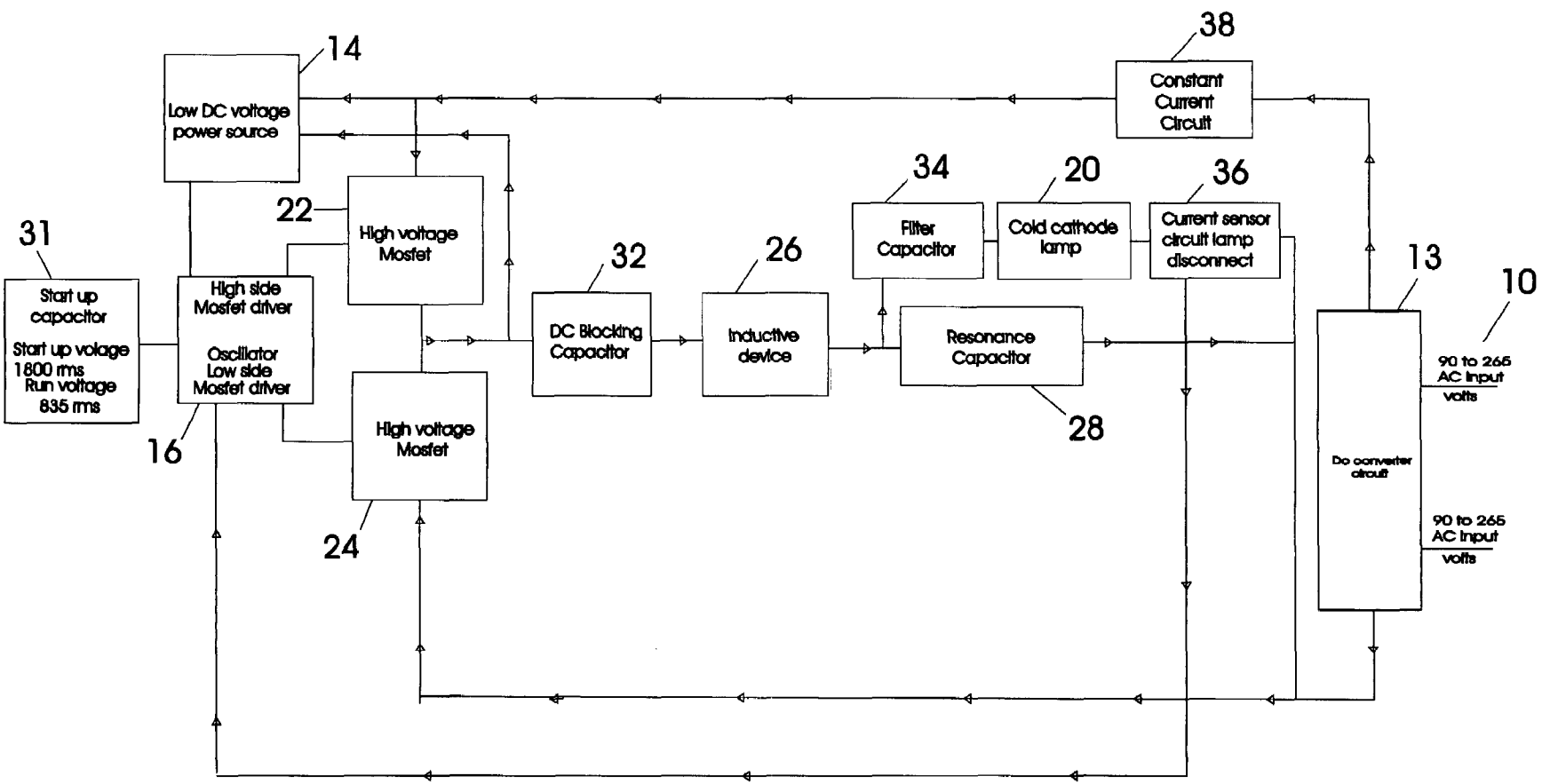
FIG. 8 is a schematic diagram of another preferred embodiment of the circuit of the subject invention.
Figure 9:
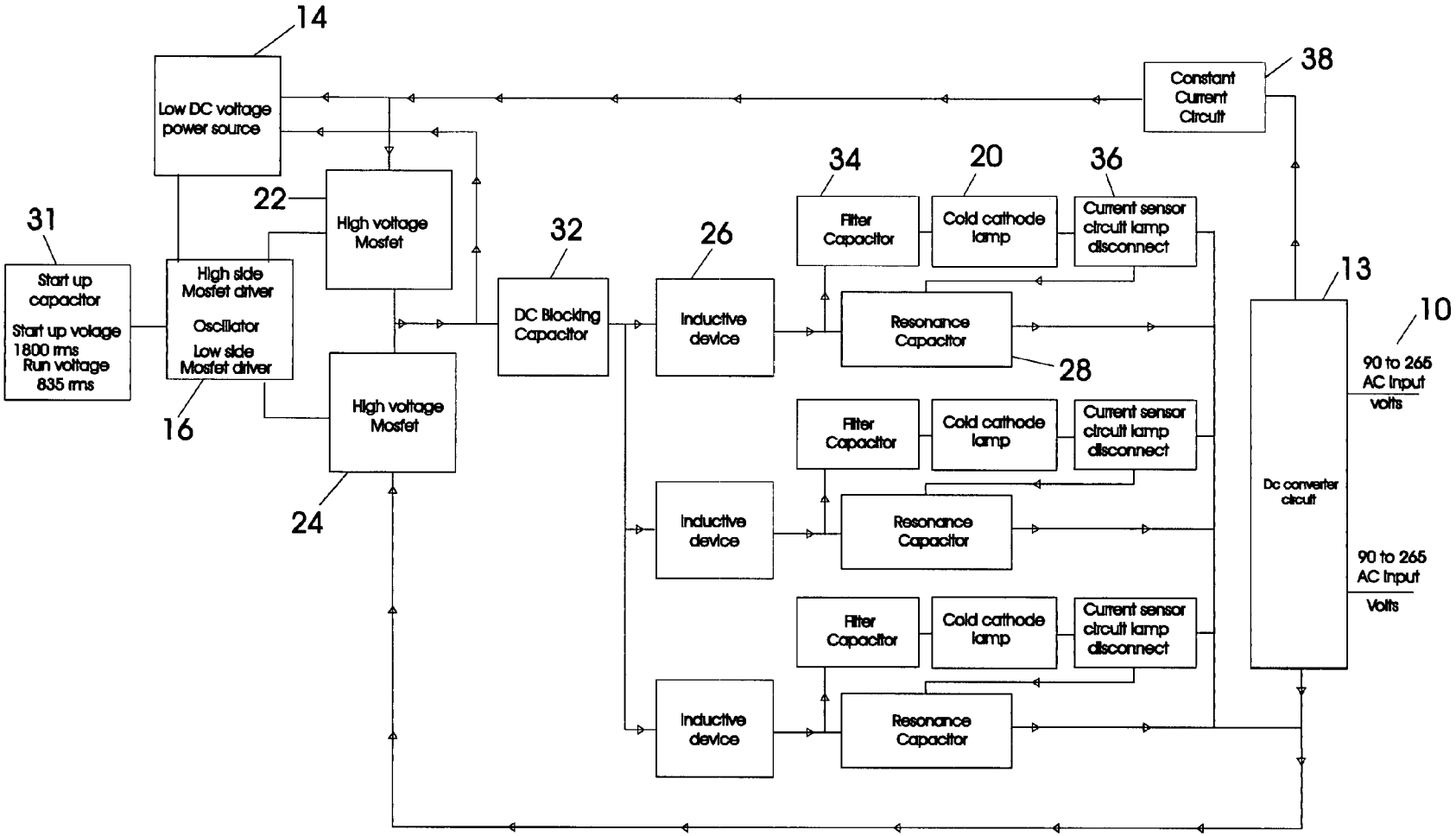
FIG. 9 is a schematic diagram of another preferred embodiment of the circuit of the subject invention.

FIGS. 8 and 9 is a schematic drawing of another preferred embodiment of the circuit of the subject invention. In this embodiment, the current supplied to the lamp is controlled by regulating the supply voltage. A constant current feedback circuit 38 monitors voltage and controls the current supplied to the cold cathode tube.

It is understood that the foregoing examples are merely illustrative of the present invention. Certain modifications of the articles and/or methods employed may be made and still achieve the objectives of the inventions. Such modifications are contemplated as within the scope of the claimed invention.

What is claimed is:

1. A circuit for driving cold cathode tubes comprising:
- an oscillator having a high side MOSFET driver and a low side MOSFET driver;
- two high voltage MOSFETs;
- a resistor/capacitor network; and
- a set of resonance elements comprising a single wound inductive storage device, a resonance capacitor and a cold cathode tube, wherein said resistor/capacitor network directs said oscillator to achieve a first resonance frequency to drive said resonance elements and causes said cold cathode tube to conduct and thereafter said resistor/capacitor network directs said oscillator to achieve a second resonance frequency to drive said resonance elements and illuminate said cold cathode tube.

2. The circuit of claim 1, further comprising a low direct current voltage power source to supply power to said oscillator.

3. The circuit of claim 1, wherein said circuit has a first resistor/capacitor network to direct said oscillator to achieve said first resonance frequency and a second resistor/capacitor network to direct said oscillator to achieve said second resonance frequency.

4. The circuit of claim 1, wherein said set of resonance elements further comprises a filter capacitor and said circuit further comprises a current sensor.

5. The circuit of claim 1, wherein said circuit further comprises a direct current converter circuit to rectify and filter an alternating current input.

6. The circuit of claim 5, wherein said direct current converter circuit is a split voltage device.

7. The circuit of claim 5, wherein said direct current converter circuit is a full wave device and said circuit further comprises a direct current blocking capacitor.

8. The circuit of claim 4, wherein said circuit has at least two sets of resonance elements.

9. A circuit for driving cold cathode tubes comprising:
- a full wave direct current power converter;
- a low direct current voltage power source;
- an oscillator having a high side MOSFET driver and a low side MOSFET driver;
- two high voltage MOSFETs;
- a direct current blocking capacitor;
- a resistor/capacitor network;
- a set of resonance elements comprising a single wound inductive storage device, a filter capacitor, a resonance capacitor and a cold cathode tube, and
- a current sensor, wherein said resistor/capacitor network directs said oscillator to achieve a first resonance frequency to drive said resonance elements and causes said cold cathode tube to conduct and thereafter said resistor/capacitor network directs said oscillator to achieve a second resonance frequency to drive said resonance elements and illuminate said cold cathode tube.

10. The circuit of claim 9, wherein said circuit comprises a plurality of sets of resonance elements and a plurality of current sensors.

11. A circuit for driving cold cathode tubes comprising:
- a split voltage direct current power converter;
- a low direct current voltage power source;
- an oscillator having a high side MOSFET driver and a low side MOSFET driver;
- two high voltage MOSFETs;
- a resistor/capacitor network; and
- a set of resonance elements comprising a single wound inductive storage device, a resonance capacitor and a cold cathode tube, wherein said resistor/capacitor network directs said oscillator to achieve a first resonance frequency to drive said resonance elements and causes said cold cathode tube to conduct and thereafter said resistor/capacitor network directs said oscillator to achieve a second resonance frequency to drive said resonance elements and illuminate said cold cathode tube.

12. The circuit of claim 11, wherein said circuit has a first resistor/capacitor network to direct said oscillator to achieve said first resonance frequency and a second resistor/capacitor network to direct said oscillator to achieve said second resonance frequency.

* * * * *